US005875925A

United States Patent [19]

Stevens

[11] Patent Number: 5,875,925

[45] Date of Patent: Mar. 2, 1999

[54] METHODS AND APPARATUS FOR TRANSFERRING HAZARDOUS LIQUIDS

[75] Inventor: Alec Martin Stevens, Queensland, Australia

[73] Assignee: Stevens Eva Josephine, Cleveland, Australia

[21] Appl. No.: 875,328

[22] PCT Filed: Dec. 20, 1995

[86] PCT No.: PCT/AU95/00869

§ 371 Date: Jun. 20, 1997

§ 102(e) Date: Jun. 20, 1997

[87] PCT Pub. No.: WO96/19407

PCT Pub. Date: Jun. 27, 1996

[30] Foreign Application Priority Data

| | | | |
|---|---|---|---|
| Dec. 20, 1994 | [AU] | Australia | PN0187 |
| Dec. 20, 1995 | [ZA] | South Africa | 95/10831 |

[51] Int. Cl.[6] ..... B67D 5/08

[52] U.S. Cl. ..... 222/67; 222/158; 222/383.1; 222/442

[58] Field of Search ..... 222/67, 158, 375, 222/383.1, 442, 444, 450; 137/205

[56] References Cited

U.S. PATENT DOCUMENTS

| | | | |
|---|---|---|---|
| 2,587,060 | 2/1952 | Meyer | 222/158 |
| 4,567,908 | 2/1986 | Bolsterli | 222/375 |
| 5,148,945 | 9/1992 | Geatz | 137/205 |

*Primary Examiner*—Philippe Derakshani
*Attorney, Agent, or Firm*—Abelman, Frayne & Schwab

[57] ABSTRACT

Liquid handling apparatus includes a transfer vessel adapted to receive and retain a predetermined volume of liquid between an upper air-inlet and lower liquid inlet/outlet, the latter being an opening in the base connected to a liquid-flow delivery and suction pipe of desired length, the latter having an open terminal end downstream of a manually controllable on/off valve, the terminal end being adapted to be placed in liquid communication with a supply vessel or dispensing container.

5 Claims, 5 Drawing Sheets

21
32
30
10
23
26
20
12
19
4
3
2
1
11
27
24
22
14
13
15
25
17
16

22
32
30
25
26
28
21
11
29
31
10
15
16
18

METHODS AND APPARATUS FOR TRANSFERRING HAZARDOUS LIQUIDS

TECHNICAL FIELD OF THE INVENTION

THIS INVENTION relates to liquid control and/or supply systems, and it has particular but not exclusive reference to the safe handling of chemical substances in liquid form.

BACKGROUND ART

There have always been many instances in which liquid chemicals need to be supplied in appropriate volumes to containers from which they are progressively dispensed, while retrieval of the remaining contents after a period of dispensing will in most cases be necessary or desirable. We have found this very pertinent in relation to liquid pre-mix weedicides to be applied by spraying via an agricultural machine, or applied by wick-rope wiping action as in our Australian Patent No. 529361. Whether the liquid chemicals be weedicide or extremely hazardous chemicals, it is obviously desirable that supply and/or retrieval be accomplished with a minimum of spillage since this is harmful to the environment as well as to the operators. Often after a period of use such as at the end of a day, it is necessary to clean pumps and/or other components associated with the distribution containers, thus increasing the risks of spillage. The large number of similar practical applications of this type will be known to users of such equipment or will be apparent from the discussions herein in relation to the present invention.

OBJECTS OF THE INVENTION

The present invention arises from considering ways of dealing with the spillage problems as aforementioned, and it accordingly has for its principal object to provide such improvements in relation to supplying or retrieving liquid from containers that the likelihood of spillage will be greatly reduced or totally removed. A particular object of the invention is to provide apparatus and methods of handling liquids whereby a set quantity or predetermined or selectively variable volume may be delivered with accuracy and efficiency from a supply vessel therefor to a dispensing container, for any one of the many purposes for which such action might be required. It is a further object to provide features in the method and apparatus whereby the residual volume in the container may be retrieved easily, quickly and accurately without spillage when it is necessary to do so.

Yet another object of the invention is to provide liquid supply apparatus of the character described which may be of very simple and inexpensive nature, being able to be handled for all purposes by a single operator if necessary, and which will avoid the need for dismantling pumps or other ancillary equipment for cleaning same because of the need to clear contained residual chemicals.

The invention also aims to provide methods and apparatus for the above purposes utilising suction pump means for withdrawing air from a vessel so as to suck liquid in to take the place of the air, but having such further improvements that the suction pump means will not be reached by liquid contained in bubbles in the withdrawn air arising from liquid agitation of any kind.

Yet another object of the invention is to provide apparatus of the type described which may be utilised in principle, with minor modifications if necessary, to retrieve chemical spills of the type which currently occur far too frequently and which allow hazardous chemicals to enter watercourses or to pollute large areas of land. Other objects and advantages of the invention will be hereinafter apparent.

DISCLOSURE OF THE INVENTION

With the foregoing and other objects in view, the invention resides broadly, according to one aspect, in a method of transferring a volume of liquid from a liquid supply vessel to a dispensing container, including the steps of:

(1) arranging a transfer vessel having an upper vent valve so that its lower end is in liquid communication via pipe means with the contents of the supply vessel;

(2) applying suction by suction pump means through an upper part of the transfer vessel to draw a volume of liquid from the supply vessel into the transfer vessel while maintaining the said upper vent valve closed, and including the step of simultaneously causing air withdrawn by the suction pump means from the transfer vessel to pass through a bubble extraction chamber interposed between the transfer vessel and the suction pump means so that any bubbles contained in the air will have their liquid content separated from the air content and allowed to settle while the air continues its passage, thus preventing liquid reaching the suction pump means;

(3) retaining the volume of liquid in the transfer vessel by preventing return flow through said pipe means;

(4) placing the transfer vessel above the dispensing container and transferring said pipe means from the supply vessel to communicate with an upper part of the dispensing container;

(5) discontinuing the prevention of return flow through said pipe means, and (6) allowing air to enter the transfer vessel via said upper vent valve whereby suction effects caused by said suction pump means will be rendered ineffective and the liquid in the transfer vessel will flow gravitationally into the dispensing container.

The invention also embraces the method of subsequently retrieving residual liquid or residue from the dispensing container, including the steps of using the transfer vessel for receiving liquid from the dispensing container by steps (1), (2) and (3) above when the pipe means is in communication with the dispensing container in lieu of the liquid supply vessel, and then carrying out steps (4), (5) and (6) above after transferring the pipe means From the dispensing container to the supply container or to an alternative receptacle for said residue.

According to another aspect of the invention for carrying out the above method, there is provided apparatus for use in supplying liquid from a supply vessel to a dispensing container, said apparatus including:

a transfer vessel adapted to receive and retain a predetermined volume of liquid between air-inlet means at an upper part thereof and liquid inlet/outlet means at a lower part thereof, said inlet/outlet means having liquid-flow pipe means adapted to be placed in liquid communication via on/off valve means with either the liquid supply vessel or the dispensing container as desired, said air-inlet means being connected by air-flow passage means to suction pump means adapted to be actuated selectively to withdraw air to desired extent from the transfer vessel so that liquid will be drawn through said inlet/outlet means when the latter is in liquid communication as aforesaid, said air-flow passage means having liquid-flow valve means operable automatically to prevent liquid entering the air-flow passage means upon reaching a predetermined level in the transfer vessel, and also having a vent valve or air-suction release valve adapted to be actuated when desired to admit atmospheric air to the upper part of the transfer vessel and render the suction action ineffective, there also being provided a bubble extraction chamber interposed between the air-flow passage means and the suction rump means, the chamber being of enlarged volume relative to the pump suction line, the latter being of restricted cross-section, and the arrangement being such that air drawn towards the suction pump means from the transfer vessel and containing liquid bubbles arising from liquid agitation will be drawn under pressure through an air entry aperture to the chamber to impinge against the upper wall section thereof so as to separate the air from its liquid content, the air then being drawn from the chamber to a continuing portion of the pump suction line through an air outlet aperture in an upper wall section of the chamber spaced from said air entry aperture., the chamber having a base portion on which separated liquid can settle and be collected for subsequent removal, the parts being further so made and arranged that the transfer vessel can be used initially to receive and retain a is volume of liquid by placing the liquid-flow pipe means in liquid communication with the contents of the liquid supply vessel while the on/off valve means is disposed to permit flow, whereafter the suction pump means may be actuated to draw liquid from the supply vessel to predetermined volume while the vent valve is maintained closed, the volume of liquid being delivered to the dispensing container by transferring liquid communication of the liquid-flow pipe means from the supply vessel to the dispensing container placed beneath the transfer vessel so that when the on/off valve means of the liquid-flow pipe means is opened, liquid in the transfer vessel will flow gravitationally into the dispensing container upon opening the said vent valve.

It will be appreciated that the features denoted for the above apparatus will enable it to be used also for retrieving residual liquid from the dispensing container and transferring it back to the liquid supply vessel or to another chosen receptacle for such residue.

While the above aspects are pertinent to using a transfer vessel as an intermediary between a supply vessel and a distribution vessel, the invention can be applied with modifications to the retrieval of chemical spills. Thus, according to another aspect, the invention resides broadly in a method of transferring liquid from a supply thereof including the steps of:

(1) arranging a transfer vessel having an upper vent valve so that it is in liquid communication via pipe means with a supply of liquid to be transferred;

(2) applying suction by suction Dump means through an upper part of the transfer vessel to exert suction and withdraw air from the upper part of the transfer vessel whereby liquid will be caused to be withdrawn from the supply thereof and through said pipe means into the transfer vessel to replace air withdrawn by the suction pump means, while maintaining the said upper vent closed, and including the step of simultaneously causing air withdrawn by the suction pump means from the transfer vessel to pass through a bubble extraction chamber interposed between the transfer vessel and the suction pump means so that any bubbles contained in the air will have their liquid content separated from the air content and allowed to settle while the air continues its passage, thus preventing liquid reaching the suction pump means; and (3) discontinuing the operation of the suction pump means and causing the upper vent valve to be opened after a required volume of liquid has been drawn into the transfer vessel and with the vessel being arranged to retain said volume until subsequent removal steps are initiated. Suitably, for carrying out this method, according to another broad aspect, there is provided apparatus for use in transferring liquid from a supply thereof including:

a transfer vessel adapted to receive and retain liquid from said supply via a supply suction pipe connected at one of its ends to the vessel while its other end is adapted to be inserted in the supply of liquid;

a pump suction line connected to an opening at an upper portion of the transfer vessel above the intended maximum liquid level and leading to suction pump means adapted to be actuated to exert suction and withdraw air from the upper portion of the transfer vessel whereby liquid may be caused to be drawn from the supply thereof through the supply suction pipe and into the transfer vessel to replace air withdrawn by the suction pump means;

a bubble extraction chamber interposed in said pump suction line and of enlarged volume relative to the pump suction line, the latter being of restricted cross-section, and the parts being so made and arranged that air drawn towards the suction pump means from the transfer vessel and containing liquid bubbles arising from liquid agitation will be drawn under pressure through an air entry aperture to the chamber to impinge against an upper wall section thereof so as to separate the air from its liquid content, the air then being drawn from the chamber to a continuing portion of the pump suction line through an air outlet aperture in an upper wall section of the chamber spaced from said air entry aperture, the chamber having a base portion on which separated liquid can settle and be collected for subsequent removal.

Other features of the intention will become apparent from the following descriptions.

BRIEF DESCRIPTION OF THE DRAWINGS

In order that the invention may be more readily understood and put into practical effect, reference will now be made to the accompanying drawings, wherein.

Figure 1:
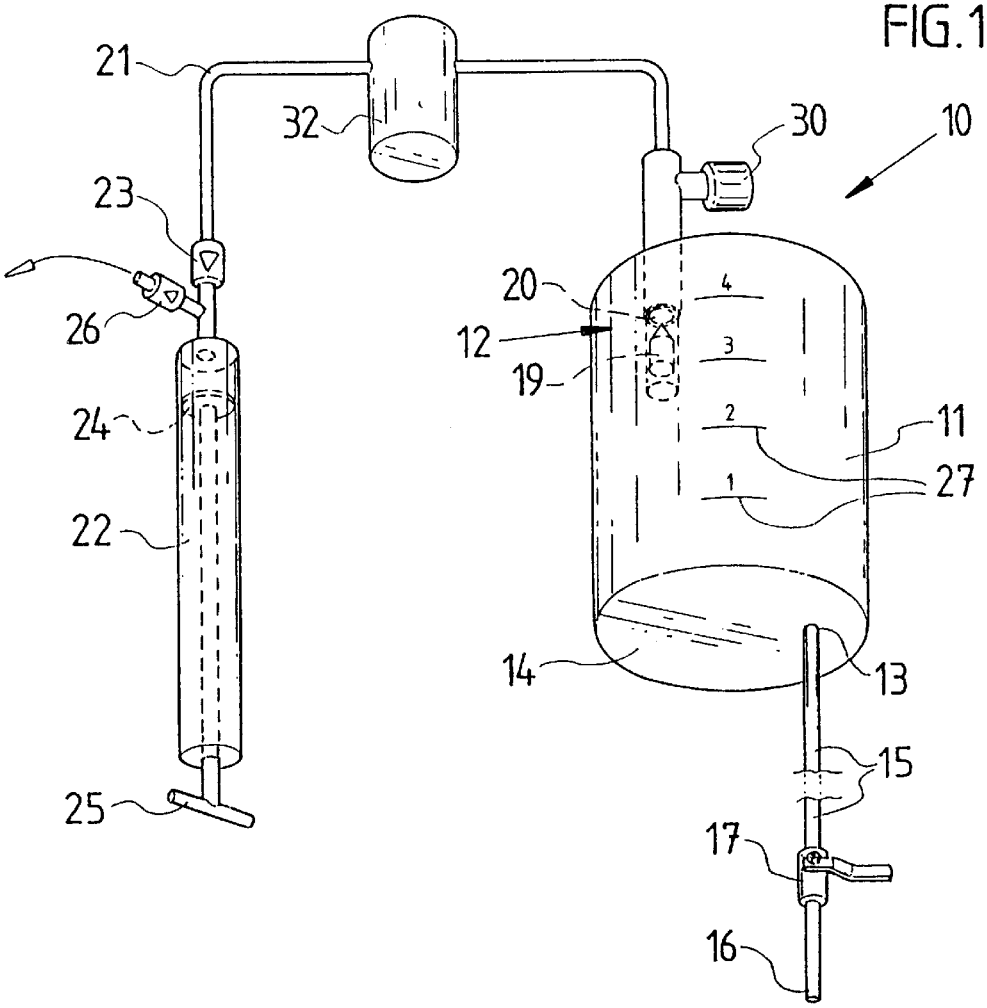
FIG. 1 shows diagrammatically the basic components of one form of liquid handling apparatus according to the invention.
Figure 2:
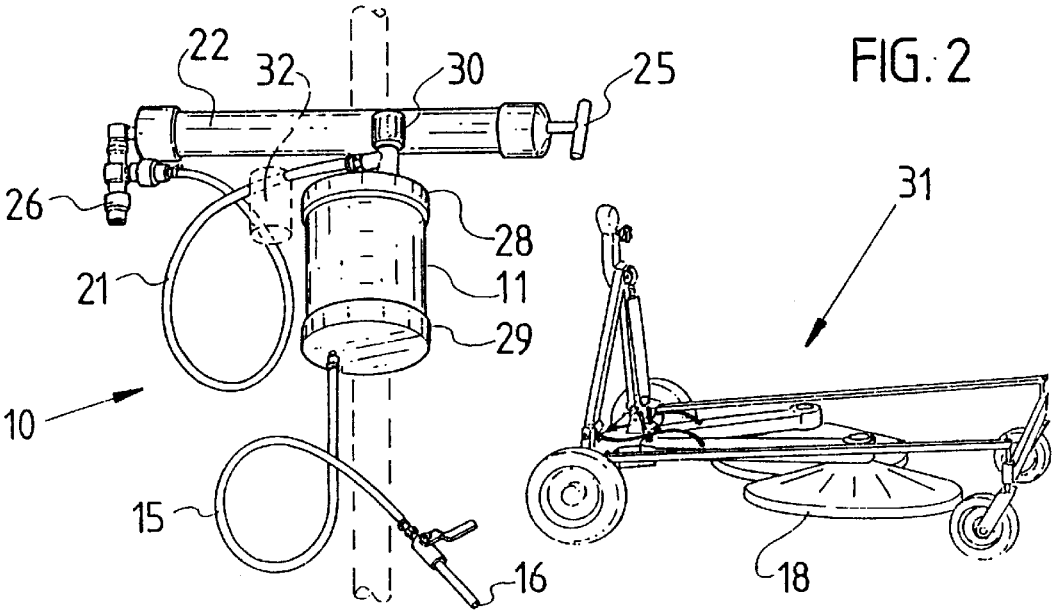
FIG. 2 shows in perspective view similar apparatus to that of FIG. 1 but shown supported by an upright structure adjacent a dispensing container of a wick-rope applicator for weedicide, given by way of example.

Referring initially to FIGS. 1 and 2 only, it will be noted from the drawings that the liquid handling apparatus indicated generally by the numeral 10 includes a transfer vessel 11 adapted to receive and retain a predetermined volume of liquid between upper air-inlet means 12 and lower liquid inlet/outlet means 13, the latter being an opening in the base 14 connected to a liquid-flow delivery and suction pipe 15 of desired length, the latter having an open terminal end 16 downstreaam of a manually controllable on/off valve or tap 17, the terminal end 16 being adapted to be placed in liquid communication with a supply vessel (not shown) or with a dispensing container such as that indicated by the numeral 18 in FIG. 2.

The air-inlet means 12 includes a floatable needle valve 19 guided for upward movement to seal against a seat 20 when liquid reaches the maximum desired level, but air suction can be applied past the needle valve 19 by means of a suction line 21 leading to a pump cylinder 22 via a one-way valve 23 which allows suction in non-return manner by the pump cylinder 22 when the plunger seal 24 is withdrawn by pulling the pump handle 25. Movement of the plunger seal 24 by pump handle 25 in the return or inwards direction is permitted by the provision of a one-way valve 26 allowing outflow of air but automatically closing when the pump handle 25 is extended so that suction will be exerted along the air suction line 21.

Naturally the valve 19 could be of any other suitable construction instead of being a needle-type valve. Also the valve 26 which allows out-flow of air could lead via any pipe or equivalent means to an area exterior of a building and away from the workplace to cater for the fact that noxious Fumes or the like might be sucked from the transfer vessel and discharged at the valve 26 under certain circumstances.

The transfer vessel 11 may be of any desired shape and size according to the application, suitably being transparent in its chamber portion so that graduations 27 indicate the visible volume of liquid drawn therein from its bottom. The vessel 11 in FIG. 2 has a cylindrical body with secured upper and lower caps 28 and 29 for the connections to the upper suction line 21 and the lower liquid line 15 respectively. A vent valve 30 is provided so that, when desired, air can be admitted to the upper end of the transfer vessel 11 and thus render ineffective suction effects provided by actuation of the pump plunger within the pump cylinder 22.

The method of using the apparatus will be self-apparent and has already been set out in defining the broad features of the inventive method and preferred embodiments of apparatus for carrying out the methods. In addition, various known forms of quick-release couplings may be employed, including where necessary valves operating to closed attitude automatically when not connected for flow purposes. Also sealing means can be incorporated to ensure air-tight seals wherever connections are made. It will be apparent that the invention enables supply of a measured quantity of chemical at any time and for any purpose, such as for supplying pre-mixed chemicals from a supply tank (not shown) to the dispensing container 18 of a mobile wick-wiper applicator machine shown at 31 in Fig. 2 and adapted to be actuated by and drawn by a tractor or the like. Such forms of apparatus for which the invention is suitable are shown in our aforesaid Australian patent specification No. 589361. Emptying of the dispensing container after use will be facilitated by sucking out the residue without possibility of spillage for delivery back to the supply vessel or to any other preferred receptacle.

Since all suction pump means can be maintained at a distance from the chemicals, only air without chemicals will contact the suction pump means so that no chemicals have to be cleaned therefrom. The invention will achieve the stated object of safe handling, so that its application to really hazardous chemical liquids will be welcomed. Its use in other applications will be self-evident, such as the application of weedicide to roadside gutter edges as dealt with in our Australian provisional patent application No. PM5692. In some applications, such as those involving less dangerous chemicals, the vacuum pump means can be mounted directly on the top or side of the transfer vessel so that the suction line 21 becomes merely a suction passage in an integral body member. Also, the lower inlet/outlet means could be varied to provide two openings for two pipes, one being used exclusively when connection is made to the supply vessel and the other being used exclusively when connecting to the dispensing container.

Indicated by the numeral 32 in FIGS. 1 and 2 is a bubble extraction assembly designed so that air withdrawn by the suction pump 22 from the transfer vessel 11 will pass therethrough and any bubbles contained in the air will have their liquid content separated from the air content and allowed to settle while the air continues its passage, thus preventing liquid from reaching the suction pump. Details of construction of the bubble extraction assembly are illustrated in FIGS. 3 to 6.

Figure 3:
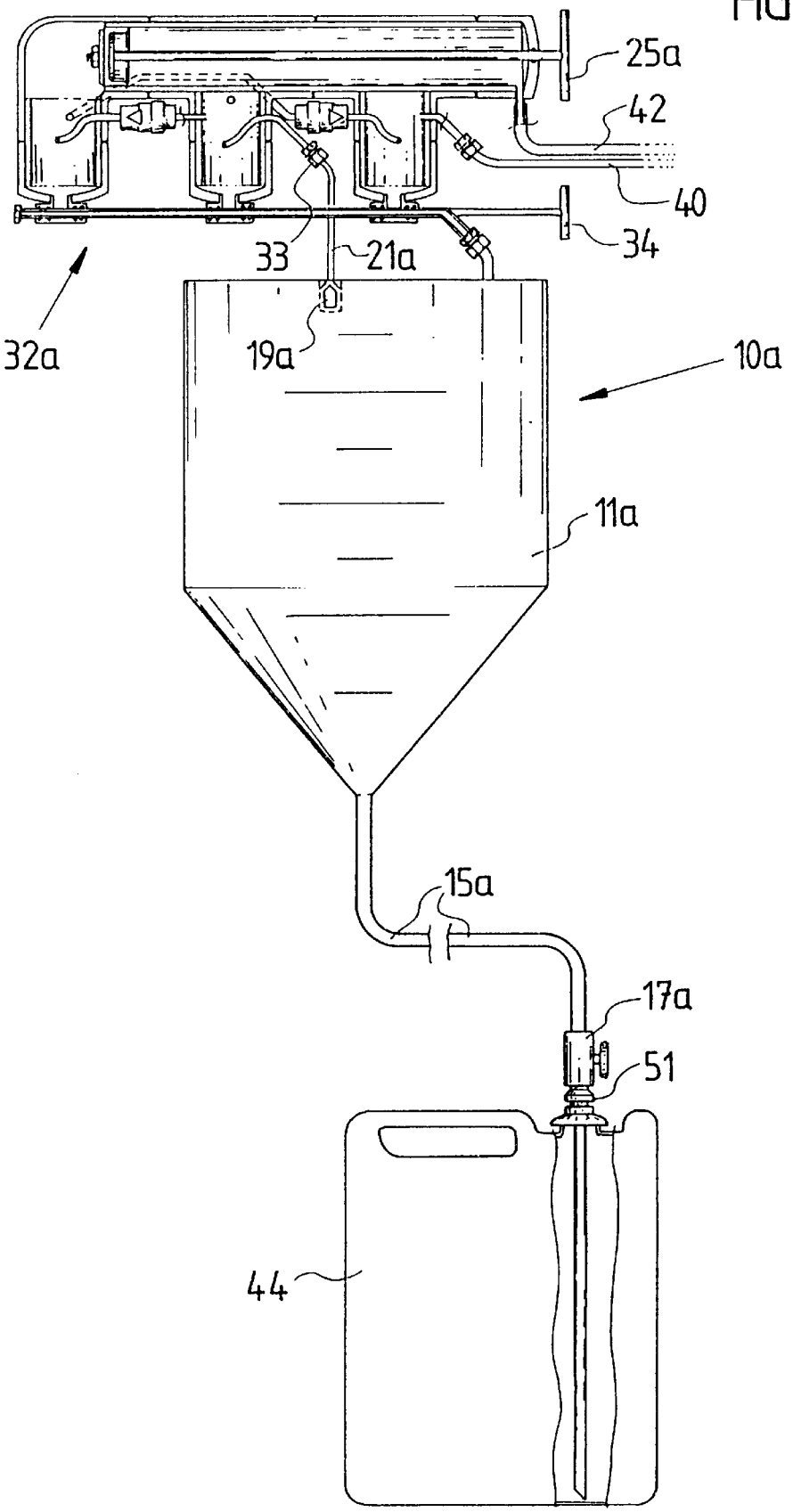
FIG. 3 shows diagrammatically in side elevation another is form of liquid handling apparatus according to another embodiment of the invention and having a bubble extraction assembly of novel form.

In the embodiment of FIG. 3, the components are given the same numerals as in FIGS. 1 and 2 but suffixed by the letter "a", while additionally the liquid source is indicated at 44 to which the suction/delivery hose 15*a* is connected through a shut-off valve 17*a* and a female coupling 51. The transfer vessel 11*a* has a float operated needle valve 19*a* so that the pump suction hose 21*a* leads to the bubble extraction assembly 32*a*, the suction pump means being operated by the handle 25*a*.

Figure 5:
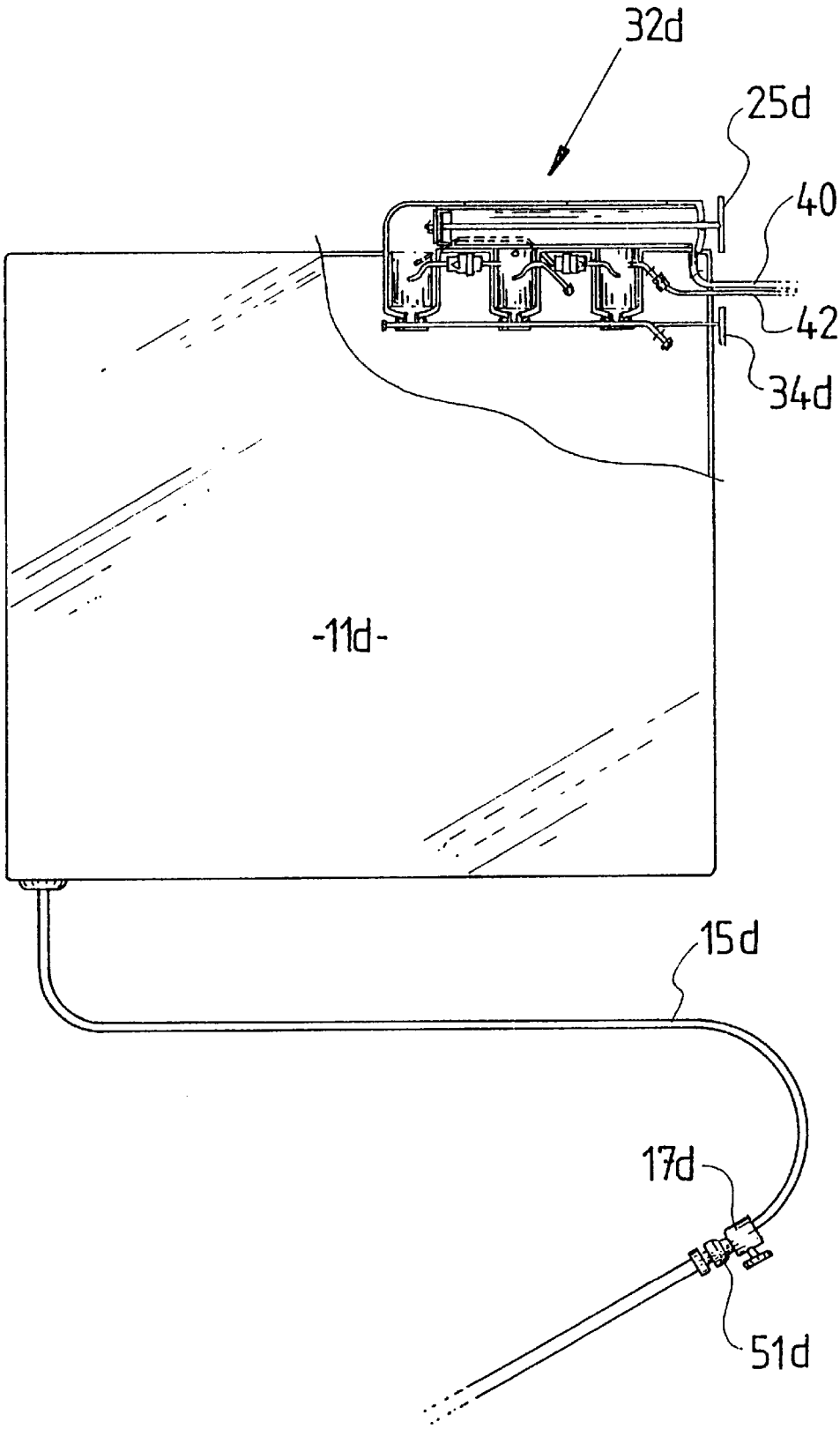
FIG. 5 shows yet another modified form of the liquid handling apparatus according to the invention with the bubble extraction assembly of FIGS. 3 and 4 fitted to a larger transfer vessel.

FIG. 5 shows a similar embodiment utilising a large vacuum/storage vessel lid having a suction/delivery hose 15*d* provided with a shut-off valve 17*d* adjacent a female coupling 51*d*. Also shown is the bubble extraction assembly 32*d* having a pump handle 25*d*, there also being illustrated a drainage control handle 34*d*.

Figure 4:
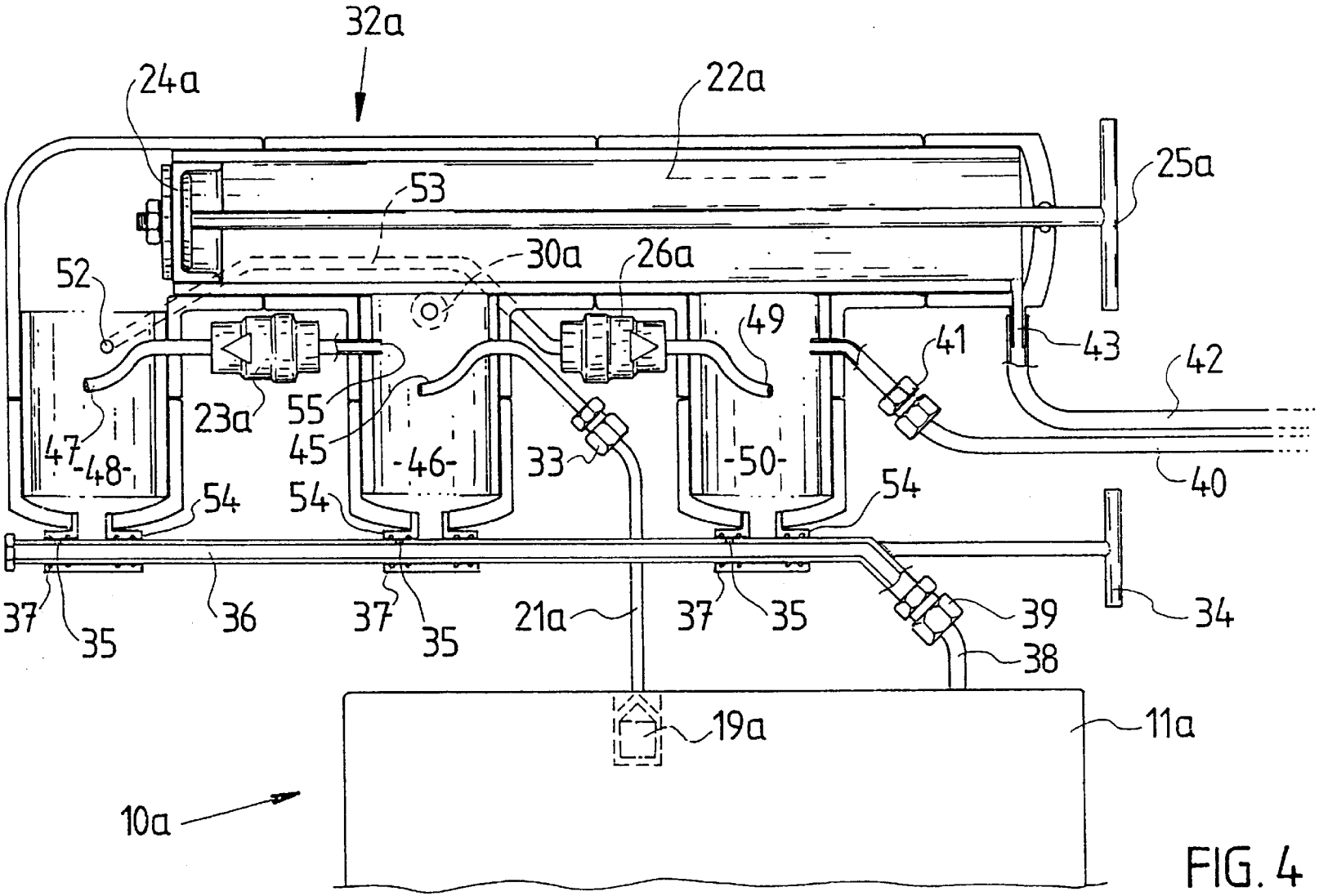
FIG. 4 shows to enlarged scale and in greater detail the bubble extraction assembly of FIG. 3.

Details of the bubble extraction assembly 32*a* will be clear from FIG. 4 which shows the inlet hose 21*a* leading from the transfer vessel 11*a* and having a connector 33 to an air direction tube 45 leading in to a primary bubble extraction chamber 46, the tube 45 being directed downwardly and around the inner wall of the chamber 46 which is cylindrical about a vertical axis. In this way, air containing bubbles will be caused to impinge under pressure against the arcuate wall at an upper level of the chamber 46 so that the liquid will be extracted and collected on the base of the chamber 46, while the air will continue through an aperture 55 at the upper end of the chamber 46 to pass through a one-way valve 23*a* into a second air direction tube 47 leading down within a secondary bubble extraction chamber 48 in the same manner as for the chamber 46.

Air will be drawn into the chamber 48 by pulling out the air pump handle 25*a* in the air pump cylinder 22*a*, the pump 24*a* being withdrawn so that the air in chamber 48 will enter an aperture 52 to pass via a pipe 53 (see dotted outline) and then through a non-return valve 26*a* to an air direction tube 49 in a final bubble extraction chamber 50, from which the air can pass to an exhaust air hose 40 connected through an exhaust air connector 41. Air can escape from the air pump cylinder 22*a* via an air breather hole 43 and a breather hose 42, the latter being taken with the air hose 40 to a remote location for hygiene purposes. Also illustrated is an air shut-off valve 30*a* which will be kept closed when suction conditions are to be maintained, but it can be opened to collapse the suction system and allow delivery gravitationally from the storage vessel 11*a* in which the float operated needle valve is illustrated in dotted lines at 19*a*.

It will be seen from FIG. 4 in particular, that each extraction chamber 46, 48 and 50 has an outlet in the lower part of its base plate together with an O-ring adaptor 54, all adaptors being in line and having a common drainage tube 36 adapted to be moved slidably by a drainage control handle 34. The tube 36 has three drainage outlets 35 adapted to register with the open bottom of each extraction chamber or to be disposed between O-ring seals 37 so that the extraction chambers will be sealably closed. When the drainage tube 36 is pulled by the control handle 34, the tube 36 receives the content of the extraction chambers so that the liquid flows through a flexible drainage hose 38 fitted with a drainage connector 39.

In operation, connection is made of the hose 21*a* to the vessel 11*a* using the connector 33. The handle 34 is operated to ensure that the outlets 35 in the drainage tube 36 are in closed position between the O-ring seals 37 at each of the extraction chambers 46, 48 and 50 with the drainage hose 38 being connected between the vessel 11*a* and the drainage connector 39. The exhaust air hose 40 is connected through the exhaust air connector 41 so that any fumes will be taken away from the operator, and it is important that the air shut-off valve 30*a* be in closed position. Also the breather hose 42 is connected to the air breather aperture 43. The suction/delivery hose 15*a* is connected to the liquid supply 44 using the female coupling 51 (see FIG. 3) with the shut-of valve 17*a*.

When the handle 25*a* is drawn out, air is drawn from the vessel 11*a* up through the air direction tube 45 to inside the bubble extraction cheer 46 and then from the chamber through the outlet 55 and one-way valve 23*a* and through the further air direction tube 47 to inside the secondary bubble extraction chamber 48 and finally into the chamber cylinder 22*a* as space is made available by the handle being pulled out. Exhaust air from behind the pump piston 24*a* passes out through the air breather 43 and breather hose 42.

When the handle 25*a* is pushed in, air in the pump cylinder 22*a* passes through the bubble extraction chamber 46 and through the aperture 52 and pipe 53 to and through the one-way valve 26*a*. It then enters the final bubble extraction chamber 50 through the air direction tube 49 and finally passes out the exhaust air hose 40.

This process is repeated until a vacuum exists in the vessel 11*a*, the shut-off valve 17*a* (see FIG. 3) being open. Further pumping may be required to repeat the process, and when the desired volume is reached in the vessel 11*a*, the shut-off valve 17*a* is closed. When the vessel 11*a* is filled to uppermost working level, the float operated needle valve 19*a* (see FIG. 3) will prevent liquid from overfilling. To discharge liquid from the vessel 11*a*, the hose 15*a* is uncoupled at the female coupling 51 from the liquid source 44 and coupled to a chosen receiving point. The drainage control handle 34 can then be pulled to open the drainage outlets 35, thus releasing vacuum in the vessel 11*a* which allows any accumulated liquid in the bubble extraction chambers 46, 48 and 50 to drain back into the vessel 11*a*. The air shut-off valve 30*a* is then opened to assist drainage of accumulated liquid from the bubble extraction chamber 46 and it will be appreciated that liquid will then flow gravitationally from the vessel 11*a*.

Figure 6:
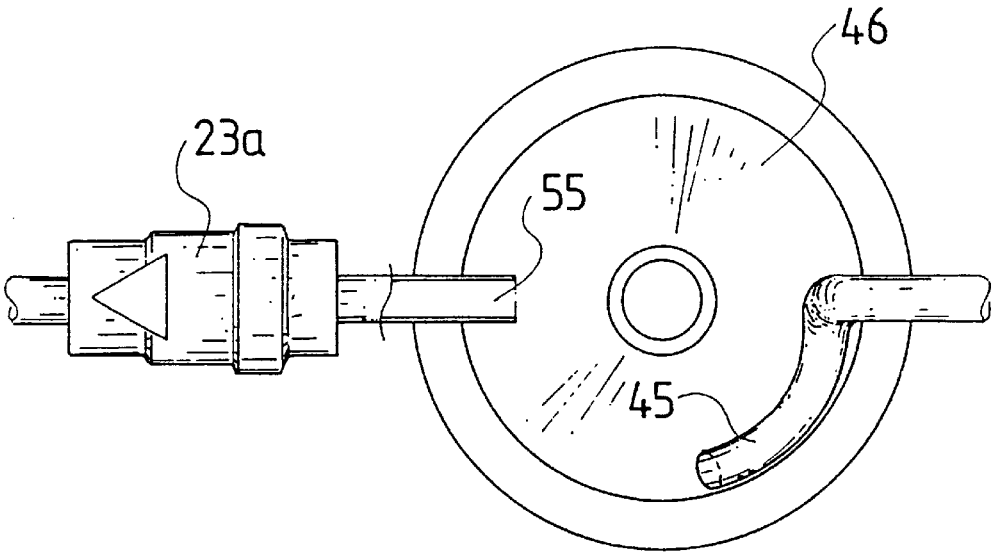
FIG. 6 shows in plan view and diagrammatically a preferred arrangement of the components in a bubble extraction chamber corresponding to those shown in FIGS. 3, 4 and 5.

The construction shown in FIG. 6 will ensure that moisture particles do not reach the suction pump. As the air pump handle 25*a* is pulled out the air travels up the intake tube 21*a* and it is directed by the air direction tubes on to the inside walls in a rotational downward direction. Air travels up the first bubble extraction chamber 46 to exit at the upper end at 55 and then through the one-way valve 23*a* and the next air directing tube 47 through to the second bubble extraction chamber 48. It will be appreciated that the air enters the extraction chamber travelling at high speed because of the small cross-section of the tube and it is directed on to the wall of the chamber in a downward rotational manner. In consequence moisture particles and bubbles adhere to the inside of the chamber and the liquid contained gravitates to the bottom. The velocity of the air travelling up inside the chamber to continue on towards the pump is reduced proportionately by the ratio of the tube size to the chamber size. Additional moisture removal is accomplished by the use of two bubble extraction chambers upstream of the pump, while there is a single further extraction chamber 50 downstream as illustrated. The significance of this "screening" process is that if air is drawn up through most liquids in the vessel 11*a*, bubbles will form on top of the liquid from the agitation process and thus may be drawn up into the air pump, this being most undesirable with chemicals of any type.

Figure 7:
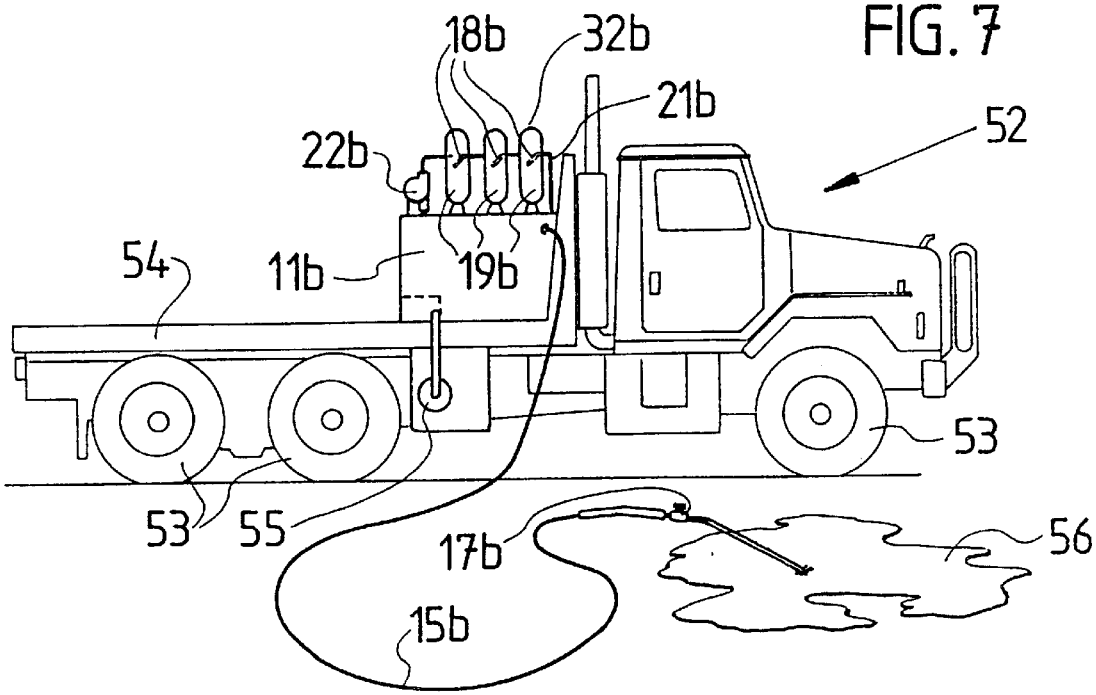
FIG. 7 illustrates the application of the invention with appropriate modifications to the retrieval of spilled hazardous liquids by a motorised vehicle carrying liquid control apparatus of another embodiment.

The application of the invention, with modifications, to retrieval of spills will be apparent from FIG. 7, where a vacuum storage tank 11*b* is mounted on the tray 54 of a motor truck 52 having wheels shown diagrammatically at 53. For convenience, the truck has a conventional liquid pump 55 so that the contents of the tank 11*b* can be directed to any place when required including elevated locations. In this case, spilt liquid indicated at 35 is picked up by a suction hose 15*b* having a shutoff valve 17*b* and leading to an upper part of the, storage tank lib as opposed to a lowermost part in the earlier embodiment. There is provided an air suction pump 22*b* receiving air via a suction line 21*b*, the air having passed through a bubble extraction assembly 32*b* having three extraction chambers 19*b* into which air is directed by three air direction tubes 18*b*. Where a spillage occurs, best results are obtained by containing the liquid within a ring of sandbags or the like, but the suction hose 15*b* will operate in any event as the system does not require a flooded suction point for it to operate, and any grit or gravel sucked up through the hose 15*b* will not travel through the pump mechanism. In this application the bubble extraction chambers 19*b* are suitably of substantial size as high volumes of air will exist and thus create high bubble volumes. As shown the hose 15*b* is connected at an upper inlet position on the vessel 11*a* adjacent the uppermost working height. The bubble extraction chambers are preferably of transparent material so that the buildup of liquid in them can be monitored.

While apparatus as described and illustrated will be found very effective in carrying out the novel methods of the invention and achieving the objects for which the invention has been devised, it will be apparent that many modifications of constructional detail and design may be made, falling within the scope and ambit of the invention as defined by the appended claims.

I claim:

1. A method of transferring a volume of liquid from a liquid supply vessel to a dispensing container, including the steps of:

(1) arranging a transfer vessel having an upper vent valve so that its lower end is in liquid communication via pipe means with the contents of the supply vessel;

(2) applying suction by suction pump means through an upper part of the transfer vessel to draw a volume of liquid from the supply vessel into the transfer vessel while maintaining the said upper vent valve closed, and including the step of simultaneously causing air withdrawn by the suction pump means from the transfer vessel to pass through a bubble extraction chamber interposed between the transfer vessel and the suction pump means so that any bubbles contained in the air will have their liquid content separated from the air content and allowed to settle while the air continues its passage, thus preventing liquid reaching the suction pump means;

(3) retaining the volume of liquid in the transfer vessel by preventing return flow through said pipe means;

(4) placing the transfer vessel above the dispensing container and transferring said pipe means from the supply vessel to communicate with an upper part of the dispensing container;

(5) discontinuing the prevention of return flow through said pipe means, and (6) allowing air to enter the transfer vessel via said upper vent valve whereby suction effects caused by said suction pump means will be rendered ineffective and the liquid in the transfer vessel will flow gravitationally into the dispensing container.

2. The method according to claim 1, used for retrieving residual liquid or residue from the dispensing container, including the steps of using the transfer vessel for receiving liquid from the dispensing container by steps (1), (2) and (3) of claim 1 when the pipe means is in communication with the dispensing container in lieu of the liquid supply vessel, and then carrying out steps (4), (5) and (6) of claim 1 after transferring the pipe means from the dispensing container to the supply container or to an alternative receptacle for said residue.

3. Apparatus for use in supplying liquid from a supply vessel to a dispensing container, said apparatus including:

a transfer vessel adapted to receive and retain a predetermined volume of liquid between air-inlet means at an upper part thereof and liquid inlet/outlet means at a lower part thereof, said inlet/outlet means having liquid-flow pipe means adapted to be placed in liquid communication via on/off valve means with either the liquid supply vessel or the dispensing container as desired, said air-inlet means being connected by air-flow passage means to suction pump means adapted to be actuated selectively to withdraw air to desired extent from the transfer vessel so that liquid will be drawn through said inlet/outlet means when the latter is in liquid communication as aforesaid, said air-flow passage means having liquid-flow valve means operable automatically to prevent liquid entering the air-flow passage means upon reaching a predetermined level in the transfer vessel, and also having a vent valve or air-suction release valve adapted to be actuated when desired to admit atmospheric air to the upper part of the transfer vessel and render the suction action ineffective, there also being provided a bubble extraction chamber interposed between the air-flow passage means and the suction pump means, the chamber being of enlarged volume relative to the pump suction line, the latter being of restricted cross-section, and the arrangement being such that air drawn towards the suction pump means from the transfer vessel and containing liquid bubbles arising from liquid agitation will be drawn under pressure through an air entry aperture to the chamber to impinge against the upper wall section thereof so as to separate the air from its liquid content, the air then being drawn from the chamber to a continuing portion of the pump suction line through an air outlet aperture in an upper wall section of the chamber spaced from said air entry aperture, the chamber having a base portion on which separated liquid can settle and be collected for subsequent removal, the parts being further so made and arranged that the transfer vessel can be used initially to receive and retain a volume of liquid by placing the liquid-flow pipe means in liquid communication with the contents of the liquid supply vessel while the on/off valve means is disposed to permit flow, whereafter the suction pump means may be actuated to draw liquid from the supply vessel to predetermined volume while the vent valve is maintained closed, the volume of liquid being delivered to the dispensing container by transferring liquid communication of the liquid-flow pipe means from the supply vessel to the dispensing container placed beneath the transfer vessel so that when the on/off valve means of the liquid-flow pipe means is opened, liquid in the transfer vessel will flow gravitationally into the dispensing container upon opening the said vent valve.

4. A method of transferring liquid from a supply thereof including the steps of:

(1) arranging a transfer vessel having an upper vent valve so that it is in liquid communication via pipe means with a supply of liquid to be transferred;

(2) applying suction by suction pump means through an upper part of the transfer vessel to exert suction and withdraw air from the upper part of the transfer vessel whereby liquid will be caused to be withdrawn from the supply thereof and through said pipe means into the transfer vessel to replace air withdrawn by the suction pump means, while maintaining the said upper vent closed, and including the step of simultaneously causing air withdrawn by the suction pump means from the transfer vessel to pass through a bubble extraction chamber interposed between the transfer vessel and the suction pump means so that any bubbles contained in the air will have their liquid content separated from the air content and allowed to settle while the air continues its passage, thus preventing liquid reaching the suction pump means; and (3) discontinuing the operation of the suction pump means and causing the upper vent valve to be opened after a required volume of liquid has been drawn into the transfer vessel and with the vessel being arranged to retain said volume until subsequent removal steps are initiated.

5. Apparatus for use in transferring liquid from a supply thereof including:

a transfer vessel adapted to receive and retain liquid from said supply via a supply suction pipe connected at one of its ends to the vessel while its other end is adapted to be inserted in the supply of liquid;

a pump suction line connected to an opening at an upper portion of the transfer vessel above the intended maximum liquid level and leading to suction pump means adapted to be actuated to exert suction and withdraw air from the upper portion of the transfer vessel whereby liquid may be caused to be drawn from the supply thereof through the supply suction pipe and into the transfer vessel to replace air withdrawn by the suction pump means;

a bubble extraction chamber interposed in said pump suction line and of enlarged volume relative to the pump suction line, the latter being of restricted cross-section, and the parts being so made and arranged that air drawn towards the suction pump means from the transfer vessel and containing liquid bubbles arising from liquid agitation will be drawn under pressure through an air entry aperture to the chamber to impinge against an upper wall section thereof so as to separate the air from its liquid content, the air then being drawn from the chamber to a continuing portion of the pump suction line through an air outlet aperture in an upper wall section of the chamber spaced from said air entry aperture, the chamber having a base portion on which separated liquid can settle and be collected for subsequent removal.

* * * * *